United States Patent [19]

Kutzner et al.

[11] Patent Number: 4,559,871

[45] Date of Patent: Dec. 24, 1985

[54] INK DIVIDER FOR INK FOUNTAIN ROLLERS

[75] Inventors: Willi A. P. Kutzner; Georg Schneider, both of Würzburg; Thomas Kübert, Karlstadt-Karlburg, all of Fed. Rep. of Germany

[73] Assignee: Koenig & Bauer Aktiengesellschaft, Würzburg, Fed. Rep. of Germany

[21] Appl. No.: 612,757

[22] Filed: May 21, 1984

[30] Foreign Application Priority Data

Jun. 8, 1983 [DE] Fed. Rep. of Germany ..... 3320638

[51] Int. Cl.[4] ..... B41F 31/04; B41F 31/06

[52] U.S. Cl. ..... 101/207; 101/366

[58] Field of Search ..... 101/366, 365, 207, 208, 101/209, 210, 350, 363, 148

[56] References Cited

U.S. PATENT DOCUMENTS

| | | | |
|---|---|---|---|
| 236,566 | 1/1881 | Engels | 101/210 |
| 1,165,160 | 12/1915 | Dunnet | 101/210 |
| 3,339,485 | 9/1967 | Rytterholm | 101/363 |
| 4,461,211 | 7/1984 | Wesselmann | 101/366 |

FOREIGN PATENT DOCUMENTS

| | | |
|---|---|---|
| 163297 | 11/1903 | Fed. Rep. of Germany . |
| 1961033 | 10/1971 | Fed. Rep. of Germany . |
| 3135711 | 2/1983 | Fed. Rep. of Germany . |
| 1062249 | 3/1967 | United Kingdom . |

*Primary Examiner*—J. Reed Fisher

*Attorney, Agent, or Firm*—Jones, Tullar & Cooper

[57] ABSTRACT

An ink dividing assembly for an inking roller in an ink fountain of a rotary printing press is disclosed. One or more inking bars are positioned adjacent the ink roller and carry doctor blades. Thin ink dividing plates are slideably carried in guide depressions formed by guide plates attached to the ends of the inking bars. A front surface of each ink divider plate is curved and sealingly engages the peripheral surface of the inking roller. The ink dividing plates may be spring biased in the guide depressions into contact with the ink roller.

3 Claims, 7 Drawing Figures

INK DIVIDER FOR INK FOUNTAIN ROLLERS

FIELD OF THE INVENTION

The present invention is directed generally to an ink divider for an ink fountain roller of a printing machine. More particularly, the present invention is directed to an ink divider for an inking roller of a rinse-type inking fountain for a rotary printing press. Most specifically, the present invention is directed to an ink divider for an inking roller in which the ink divider directly contacts the surface of the inking roller. Inking bars are placed adjacent the ink fountain roller. These bars include guide slots that receive thin ink dividing plates having curved or arcuate front faces which engage the peripheral surface of the ink roller. Each of the ink dividing plates is spring biased against the surface of the ink roller to form a positive seal against the ink roller. The ink dividing plates cooperate with doctor blades to define separate color zones on the periphery of the ink fountain roller.

DESCRIPTION OF THE PRIOR ART

Inking rollers for use in inking fountains in rotary printing presses are generally well known in the art. Numerous types of these fountains are used to supply ink to the inking roller which in turn transfers ink either directly or indirectly to appropriate printing means. One such type of inking fountain is a rinse-type fountain as may be seen, for example, in German Published Application No. 3,135,711.

In printing, it is often necessary to divide the ink fountain and the inking roller into two or more separate areas, each of which is then provided with ink of a certain color. Ink dividing means are thus required to divide the surface of the inking roller into the various inking zones. Such inking roller dividing devices may take the form of an absorbent wiper which rubs on the surface of the inking roller, or may typically be a generally channel shaped duct which uses a gaseous medium under pressure to provide separation between the various ink zones on the ink fountain roller. Such an ink dividing device positioned between areas conveying different colors of ink on an inking roller of a printing press may be seen in German Pat. No. 1961033.

The use of ink fountain dividers of the wiper or gaseous types results in a relatively wide area of the ink fountain roller being wiped clear of ink. Since the ink fountain roller has no ink on its surface in these dividing zones, a portion of the printing plates do not receive any ink. These uninked areas of the plates can, of course, not perform any printing and hence gaps and spaces between areas of different colors are formed. Such gaps and spaces detract from the overall quality and appearance of the printed product.

SUMMARY OF THE INVENTION

It is an object of the present invention to provide an ink divider for an inking roller.

Another object of the present invention is to provide an ink divider for an inking roller in a rinse-type inking fountain.

A further object of the present invention is to provide an ink dividing device for an inking roller which requires no gaseous medium for sealing.

Yet another object of the present invention is to provide an ink divider for an inking roller that has a narrow sealing surface.

Still a further object of the present invention is to provide an ink divider for an inking roller which will automatically adjust itself as it wears.

Yet still another object of the present invention is to provide an ink divider for an inking roller which will cause only negligible wear to the surface of the inking roller.

As will be set forth in greater detail in the description of preferred embodiments, the ink fountain divider in accordance with the present invention is comprised generally of an ink divider plate that is received in a guide slot on an inking bar supported adjacent the ink fountain roller. The ink divider plate is preferably made of thin sheet steel and has an arcuate forward face which is urged directly into contact with the surface of the inking roller by a suitable biasing means such as a leaf spring.

In contrast with the prior art wiping type dividers and the dividers which require a gaseous sealing means, the ink divider in accordance with the present invention has a very narrow sealing surface in contact with the ink fountain roller. This narrow contact area reduces the uninked portions of the roller and hence improves the overall quality and appearance of the inked product.

The ink dividing plates in accordance with the present invention directly contact the surface of the ink fountain roller and may cause some slight wear on the roller's surface. However, since the ink dividing plates are so thin, any such wear which might occur is negligible and will not adversely affect the printed image should the ink dividing plates be relocated along the roller. The ink dividing plates in accordance with the present invention are in direct contact with the ink fountain roller and wear slightly. However, since they are spring biased against the roller surface, the plates automatically adjust as any such wear occurs.

The ink dividing plates in accordance with the present invention are equally suitable for use with either oil or water based flexographic inks and other low viscosity printing inks. The plates can be used with either smooth surfaced or screen-typed surfaced inking rollers. The ink dividing plates in accordance with the present invention are easily changed since they are slideably carried in guide slots. Furthermore, they are easily and inexpensively manufactured. Finally, since they are quite thin and do not contact the surface of the ink fountain roller with an excessive amount of force, they do not become heated even at high circumferential speeds of the inking roller. Thus no special cooling means are required for the ink dividing plates in accordance with the present invention.

BRIEF DESCRIPTION OF THE DRAWINGS

While the novel features of the ink divider for inking rolls in accordance with the present invention are set forth with particularity in the appended claims, a full and complete understanding of the invention may be had by referring to the detailed description of preferred embodiments as set forth hereinafter, and as may be seen in the accompanying drawings in which:

DESCRIPTION OF PREFERRED EMBODIMENTS

Figure 1:
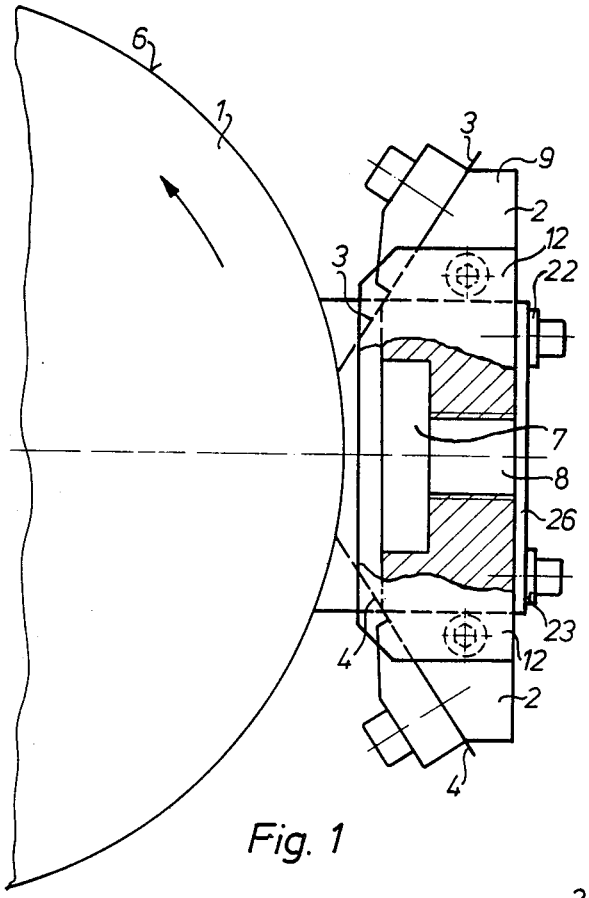
FIG. 1 is a side elevation view, partly in section of the ink dividing assembly in accordance with the present invention.

Referring initially to FIG. 1, there may be seen a preferred embodiment of an ink fountain equipped with the ink divider assembly in accordance with the present invention. The ink fountain shown in FIG. 1, and as will be discussed hereinafter is of the rinse-type, as set forth in German patent application No. 3135711. The ink dividing apparatus in accordance with the present invention cooperates with a driven screened inking roller 1 having a peripheral surface 6 to divide the peripheral surface 6 of inking roller 1 into several different colors that are then used in a printing press of known configuration.

Screened inking roller 1 is supported for rotation in suitable side frames (not shown) in a generally conventional manner. While inking roller 1 is referred to as a screen-type roller, it could also be a smooth surfaced roller as is also well known in the art. One or more inking bars 2 are positioned adjacent inking roller 1 and extend longitudinally along roller 1 generally parallel to the axis of rotation of roller 1. These inking bars 2 are supported so that they can be moved toward or away from the periphery 6 of inking roller 1. An upper doctor blade 3 and a lower doctor blade 4 are carried by each inking bar 2. When each of the inking bars 2 is positioned adjacent inking roller 1, the doctor blades 3 and 4 rest on the peripheral surface 6 of roller 1 and function in a generally known manner to control the amount of ink which adheres to the screened surface of the ink roller 1.

Figure 2:
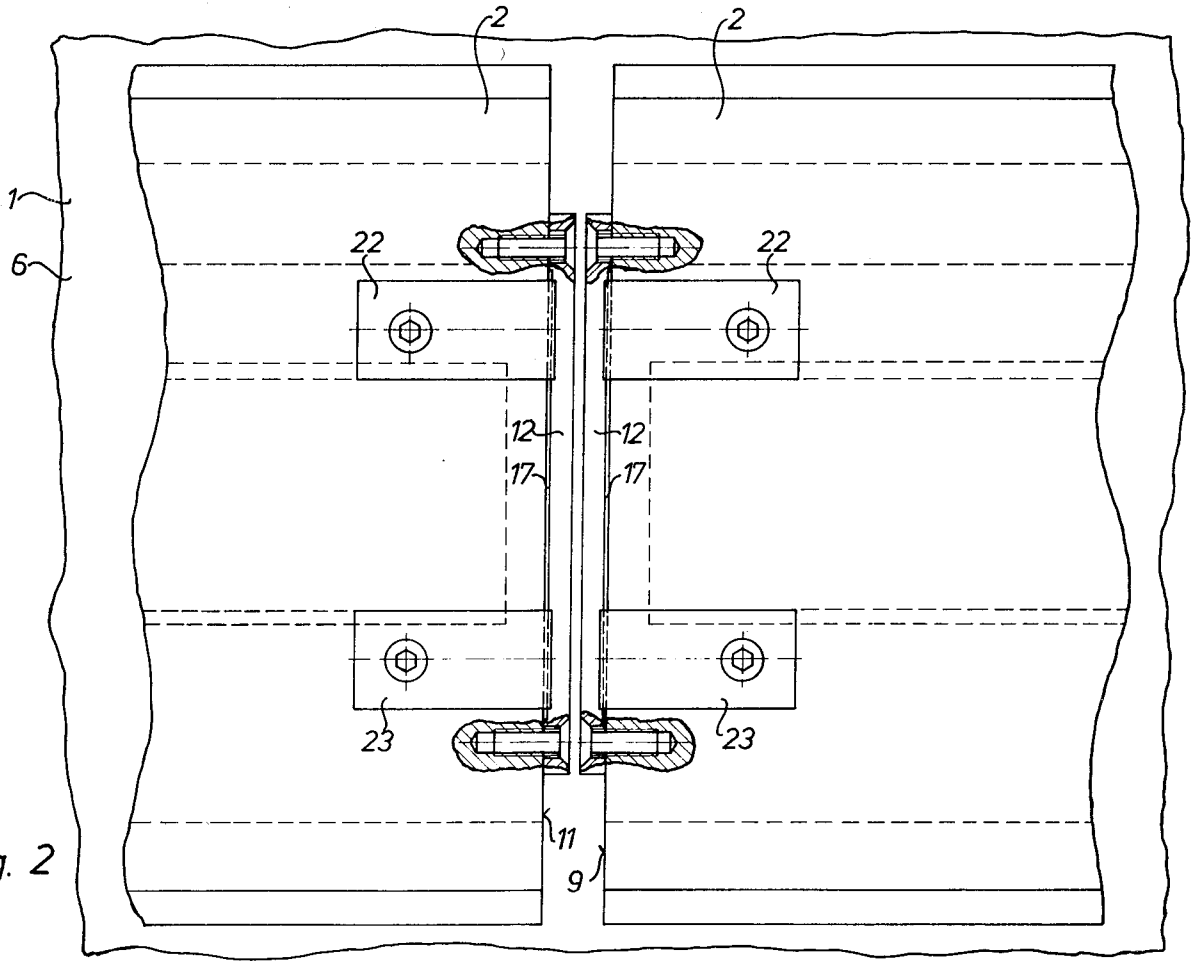
FIG. 2 is a front elevation view of the ink dividing assembly of FIG. 1 with portions removed for clarity.
Figure 7:
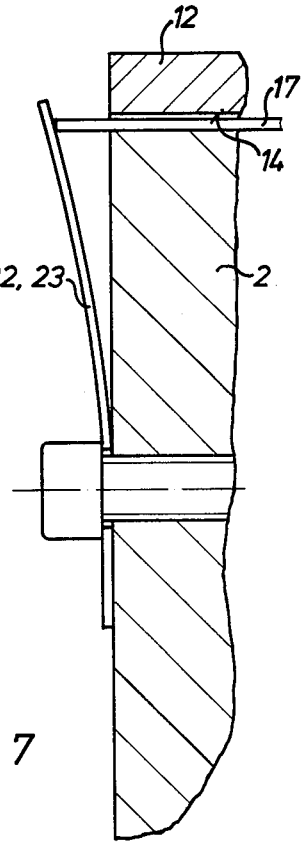
FIG. 7 is a side elevational view of an adjusting assembly to compensate for wear on the ink dividing plate in accordance with the present invention.

Each inking bar 2 is formed having a central, longitudinally extending trough or depression 7 which extends the entire length of the inking bar. Depression or trough 7 is in communication with a known ink feeding device (not shown) through a borehole 8. Guide plates 12 are secured by suitable means such as screws to first and second front surfaces 9 and 11, respectively of each inking bar 2, as may be seen in FIGS. 1 and 2. Each such guide plate 12 is oriented generally perpendicularly to the axis of rotation of inking roller 1, as may be seen most clearly in FIG. 1, and includes a guide depression 14 which is shown in FIGS. 2 and 7. This guide depression 14 lies adjacent the front surface 9 or 11 of whichever inking bar 2 the guide plate 12 is secured to.

Figure 5:
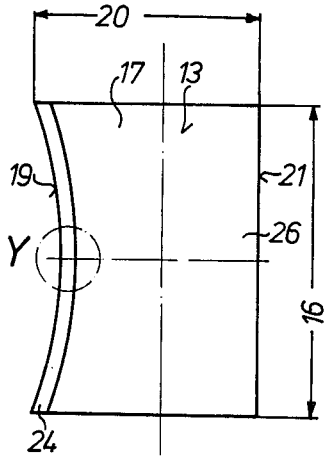
FIG. 5 is a side elevation view of a second preferred embodiment of an ink dividing plate in accordance with the present invention.
Figure 3:
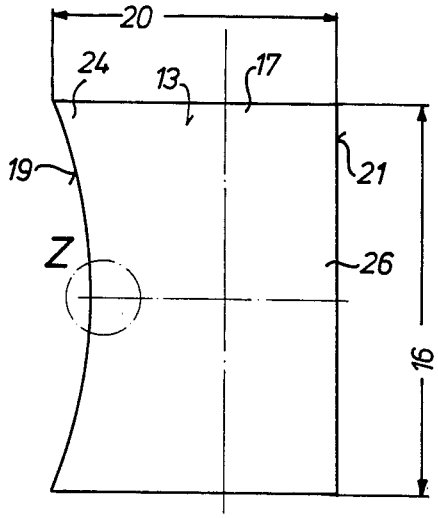
FIG. 3 is a side elevation view of a first preferred embodiment of an ink dividing plate in accordance with the present invention.

Guide depression 14 in guide plates 12 is closed at the upper and lower portions and thus forms a thin guide slot which receives an ink dividing plate 17 in accordance with the present invention and as is shown in FIGS. 3 and 5. Ink dividing plate 17 is dimensioned to be received in, and guided by, guide depression 14. Ink dividing plate 17 in accordance with the present invention has, in the preferred embodiment, a height 16 of, for example 65 mm and a length 20 of, for example 45 mm. The plate 17 has a front surface 19 which is curved or arcuate in shape and has the same radius of curvature as does the periphery 6 of screened ink roller 1. This front surface 19 forms a sealing surface when ink dividing plate 17 is brought into contact with roller 1.

A rear surface 21 of ink dividing plate 17 is preferably not curved and, as may be seen in FIGS. 1 and 7 extends beyond the rear of inking bars 2 and guide plates 12. Suitable leaf springs 22 and 23 are attached at first ends to inking bars 2 and have second, free ends that contact the rear surfaces 21 of the ink dividing plates 17, as seen most clearly in FIG. 7. It is these leaf springs 22 and 23 which bias the ink dividing plates 17 forwardly in guide depressions 14 so that the forward curved faces 19 of the ink dividing plates 17 are brought into ink sealing engagement with the surface 6 of inking roller 1.

As may be seen in FIG. 1, lateral surfaces 13 of ink dividing plates 17 contact end surfaces of doctor blades 3 and 4. Thus the ink received in trough 7 of each inking bar 2 is retained between the ink dividing plates 17 at either end of each inking bar 2 and by the upper and lower doctor blades 3 and 4. The ink dividing plates 17 are preferably positioned in guide depressions 14 and generally perpendicularly to the rotational axis of the screened ink roller 1.

Figure 6:
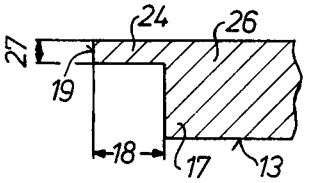
FIG. 6 is a sectional view of a portion of the ink dividing plate taken generally at Y in FIG. 5.
Figure 4:
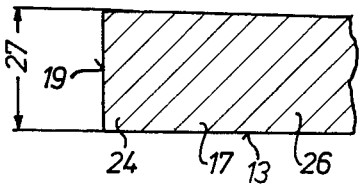
FIG. 4 is a sectional view of a portion of the ink dividing plate taken generally at Z in FIG. 3.

Referring again to FIGS. 3 and 5 and also to FIGS. 4 and 6, it may be seen that the ink dividing plates 17 are quite thin in comparison to their height and length. In the preferred embodiment the thickness of the guide piece 26 of the ink dividing plate 17 may range from 0.1 mm to several millimeters. Further, the thickness 27 of the sealing front surface 19 of the ink dividing plate 17 may be in the range of 0.03 mm to 0.3 mm. In instances in which the overall thickness of the guide piece 26 of the ink guiding plate 17 is greater than the desired thickness 27 of the front sealing surface 19, a portion of the front end 24 of plate 17 may be ground or otherwise machined away to a depth 18 of, for example 3 mm, as may be seen in FIG. 6. Such grinding or other machining of the front end 24 of ink guide plate 17 will leave the residual portion of the front end 24 with a desired thickness 27 of the sealing surface portion 19 of ink dividing plate 17. In the preferred embodiment the ink dividing plate 17 is made of hard steel sheet and in all instances, the sealing surface 19 of the ink dividing plate 17 is as thin as possible.

While preferred embodiments of an ink divider for an inking roller in an ink fountain of a rotary printing press have been fully and completely set forth hereinabove, it will be obvious to one of skill in the art that a number of changes in, for example, the number of inking bars, the type of ink roller, the various securement means and the like could be made without departing from the true spirit and scope of the invention which is accordingly to be limited only by the following claims.

We claim:

1. An ink dividing assembly for use in dividing an ink fountain roller of a rinse-type ink fountain having an ink reservoir whose front is sealed by the ink fountain roller in a rotary printing machine into a plurality of different color ink conveying areas, said ink dividing assembly comprising:

at least one inking bar positioned adjacent to, and extending longitudinally parallel to an axis of rotation of the ink fountain roller;

a guide plate secured to each end of said at least one inking bar, each of said guide plates having a guide depression cooperating with said end of said at least one inking bar to form a guide slot;

a thin ink dividing plate slideably carried in each of said guide slots, each of said ink dividing plates having a curved front surface having a thickness of between 0.03 mm and 0.3 mm and being adapted to engage the peripheral surface of the ink fountain roller, each said thin ink dividing plate being generally planar and being disposed in said guide slot generally perpendicular to the axis of rotation of the ink fountain roller, each said ink dividing plate further having a rear surface extending beyond rear surfaces of said inking bar and said guide plate; and at least first and second leaf springs attached at first ends to said rear surface of said inking bar generally adjacent each said guide slot and having second, free ends contacting said rear surface of each said thin ink dividing plate to bias each said thin ink dividing plate against the ink fountain roller, each said ink dividing plate dividing the ink fountain roller into a plurality of ink conveying areas.

2. The ink dividing assembly of claim 1 wherein each said ink dividing plate is made of a hard steel sheet.

3. The ink dividing assembly of claim 1 wherein the ink fountain roller is a screen-type roller.

* * * * *